US007214044B2

(12) United States Patent
Uekawa et al.

(10) Patent No.: US 7,214,044 B2
(45) Date of Patent: May 8, 2007

(54) COMPRESSOR HAVING AN OIL PASSAGE WHICH ONE END IS CONNECTED TO OIL COLLECTING GROOVE AND OTHER END IS OPENED TO COVER END SURFACE OF BEARING

(75) Inventors: Takashi Uekawa, Sakai (JP); Toshiyuki Toyama, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 76 days.

(21) Appl. No.: 10/477,644

(22) PCT Filed: Mar. 20, 2003

(86) PCT No.: PCT/JP03/03480

§ 371 (c)(1),
(2), (4) Date: Nov. 14, 2003

(87) PCT Pub. No.: WO03/083309

PCT Pub. Date: Oct. 9, 2003

(65) Prior Publication Data

US 2005/0069443 A1 Mar. 31, 2005

(30) Foreign Application Priority Data

Apr. 3, 2002 (JP) ..... 2002-101032

(51) Int. Cl.
*F03C 2/00* (2006.01)
*F04C 18/00* (2006.01)

(52) U.S. Cl. ..... 418/55.6; 418/55.5; 418/57; 418/94; 184/6.18

(58) Field of Classification Search ..... 418/55.1–55.6, 418/94, 57; 184/6.18
See application file for complete search history.

(56) References Cited

U.S. PATENT DOCUMENTS

| | | | | | |
|---|---|---|---|---|---|
| 4,065,279 | A | * | 12/1977 | McCullough | 418/94 |
| 4,462,772 | A | * | 7/1984 | Hazaki et al. | 418/94 |
| 4,551,082 | A | * | 11/1985 | Hazaki et al. | 418/94 |
| 4,767,293 | A | | 8/1988 | Caillat et al. | |
| RE33,236 | E | * | 6/1990 | Hazaki et al. | 418/94 |

FOREIGN PATENT DOCUMENTS

| | | |
|---|---|---|
| AU | 199935776 | 6/1999 |
| AU | 199935777 | 6/1999 |
| AU | 199935778 | 6/1999 |
| AU | 199935779 | 6/1999 |
| FR | 2780106 | 6/1998 |

(Continued)

*Primary Examiner*—Theresa Trieu
(74) *Attorney, Agent, or Firm*—Global IP Counselors, LLP

(57) ABSTRACT

A compressor for suppressing leakage of lubricating oil has a casing, a motor and a scroll mechanism coupled to the motor by a drive shaft. The drive shaft is rotatably supported by a bearing. The lubricating oil is supplied between the drive shaft and the bearing. An oil collecting portion is formed at an end portion in the axis direction of a bearing portion. The bearing portion is constituted of an outer peripheral surface of the drive shaft and an inner peripheral surface of the bearing. The oil collecting portion includes an oil groove formed in the periphery direction of the drive shaft. An oil passage is formed to conduct the lubricating oil into the oil collecting portion.

12 Claims, 6 Drawing Sheets

FOREIGN PATENT DOCUMENTS

| | | | |
|---|---|---|---|
| JP | 62-110593 | | 7/1987 |
| JP | 4-78330 | A | 7/1992 |
| JP | 4-334782 | | 11/1992 |
| JP | 05-172147 | | 7/1993 |
| JP | 6-10864 | | 1/1994 |
| JP | 06173954 | A * | 6/1994 |
| JP | 08-070552 | | 3/1996 |
| JP | 9-32758 | | 2/1997 |
| JP | 9-79153 | | 3/1997 |
| JP | 10-153186 | | 6/1998 |

* cited by examiner

COMPRESSOR HAVING AN OIL PASSAGE WHICH ONE END IS CONNECTED TO OIL COLLECTING GROOVE AND OTHER END IS OPENED TO COVER END SURFACE OF BEARING

TECHNICAL FIELD

The present invention relates to a compressor, particularly to measures against a leakage of lubrication oil.

BACKGROUND ART

Conventionally, compressors equipped with some types of compressing mechanisms, such as a scroll type and a swing type, have been used for refrigeration devices performing refrigeration cycle, such as an air conditioner.

In such compressors, as shown in Laid-Open Japanese Patent Publication No. 9-79153, a scroll-type compressing mechanism and a motor are disposed in a sealed casing, and the compressing mechanism is coupled to the motor by a drive shaft.

Further, a bearing for the drive shaft is provided between the compressing mechanism and the motor. A suction pipe is coupled to the compressing mechanism, while a discharge pipe is coupled to the casing. The discharge pipe is disposed close to the bearing.

In the compressor, the drive shaft and the bearing constitute a journal bearing. As shown in FIG. 8, a conventional journal bearing (101) comprises a drive shaft (103) and a bearing (105) through which the drive shaft (103) passes, while an oil supply passage (107) is formed in the drive shaft (103). Lubricating oil from the oil supply passage (107) through a branch passage (109) is supplied to a gap between an outer peripheral surface of the drive shaft (103) and an inner peripheral surface of the bearing (105).

The lubricating oil supplied to the gap between the drive shaft (103) and the bearing (105) generates an oil-film pressure by wedge effect, and this oil-film pressure enables the drive shaft (103) to be supported by the bearing (105) so as to rotate therein. A distribution of the oil-film pressure in the axis direction shows its characteristics shown in FIG. 9. Namely, because both of upper and lower end surfaces (111, 113) of the bearing (105) are affected by atmospheric pressure, it has the greatest oil-film pressure at its central portion in the axis direction and the pressure gradually decreases toward the both ends, having a mountain-like shape. As a result, the lubricating oil supplied to the gap between the outer peripheral surface of the drive shaft (103) and the inner peripheral surface of the bearing (105) is discharged from the both of upper and lower end surfaces (111, 113) of the bearing (105).

The lubricating oil provided at the journal bearing (101) plays important roles of not only supporting a load, but also cooling a friction heat caused by the drive shaft (103) and the bearing (105).

Problems to Be Solved

The conventional journal bearing (101) in the above-described compressor is just so constituted that lubricating oil merely flows out of the both of upper and lower end surfaces (111, 113) of the bearing (105), without taking any measures against the flowing-out of lubricating oil.

Accordingly, there was a problem that when the lubricating oil flows out of the lower end surface (113) of the bearing (105), the lubricating oil flows into and down the discharge pipe along with a coolant flowing in the discharge pipe.

Because the discharge pipe is disposed such that it opens close to the journal bearing (101). Thus, this leakage of lubricating oil caused a problem that the compressor may be lack of lubricating oil.

Herein, some measures to restrict the lubricating oil flowing out can be considered, such as reducing the amount of lubricating oil supplied to a bearing portion (115) constituted of the outer peripheral surface of the drive shaft (103) and the inner peripheral surface of the bearing (105), and sealing the both ends of the bearing portion (115) by sealing materials.

However, in the measures of reducing the supply amount of lubricating oil, the function of supporting the drive shaft (103) may deteriorate, and the cooling effect by lubricating oil may decrease. On the other hand, in the measures by the sealing materials, the cooling effect by lubricating oil may deteriorate due to stagnation of the lubricating oil at the bearing portion (115). Thus, either of measures may cause other problems.

The present invention has been devised in view of the above-described problems, and an object of the present invention is to suppress such leakage of lubricating oil by suppressing the lubricating oil flowing out of at least one end of the bearing.

DISCLOSURE OF THE INVENTION

In order to achieve the above-described object, the present invention is constituted such that lubricating oil flowing out of a bearing is conducted to a certain portion.

Specifically, the first aspect of the present invention applies to a compressor, in which a driving mechanism (9) and a compressing mechanism (7) coupled to the driving mechanism (9) by a drive shaft (11) are disposed in a casing (5), the drive shaft (11) supported by a bearing (41) so as to rotate therein supplying a lubricating oil between the drive shaft (11) and the bearing (41) through which the drive shaft (11) passes. And, it further comprises an oil collecting portion (47) that is formed at an end portion in the axis direction of a bearing portion (45) constituted of an outer peripheral surface of the drive shaft (11) and an inner peripheral surface of the bearing (41) and includes an oil groove (51) formed in the periphery direction thereof, and an oil passage (49) that conducts the lubricating oil flowing into the oil collecting portion (47) to a certain portion.

According to the first aspect of the present invention, the compressing mechanism (7) coupled to the drive shaft (11) compresses the sucked fluid by rotation of the drive shaft (11) through the driving mechanism (9), and then discharges it out of the casing (5). The lubricating oil supplied to a gap (43) between the outer peripheral surface of the drive shaft (11) and the inner peripheral surface of the bearing (41) flows toward the both ends of the bearing (41), and flows from the oil collecting portion (47) to the certain portion through the oil passage (49). As a result, it can be suppressed for the lubricating oil supplied to the gap (43) between the drive shaft (11) and the bearing (41) to flow out of the end portions of the bearing (41). Thus, because the lubricating oil is conducted to the certain portion, the oil's flowing out of the casing (5) can be suppressed.

Further, the second aspect of the present invention provides the compressor of the above-described first aspect of the invention, wherein a discharge pipe (27) openings at a portion close to the bearing (41) is attached to the casing (5).

According to the second aspect of the present invention, because it is suppressed for the lubricating oil to flow out of the end portions of the bearing (41), the lubricating oil's flowing out through the discharge pipe (27) can be suppressed securely.

Further, the third aspect of the present invention provides the compressor of the above-described first aspect of the invention, wherein the bearing (41) is formed at a frame (17) that is attached to the casing (5), and one end of the bearing (41) is constituted of an open end that is exposed from the frame (17), while the other end of the bearing (41) is constituted of a covered end that is covered by the frame (17).

According to the third aspect of the present invention, because it is suppressed for the lubricating oil to flow out of the open end of the bearing (41), the lubricating oil's flowing out through the discharge pipe (27) can be suppressed securely.

Further, the fourth aspect of the present invention provides the compressor of the above-described third aspect of the invention, wherein the oil collecting portion (47) is formed at an end portion of the bearing portion (45) that is located at a side of the open end, and the oil passage (49) is formed at the bearing (41) in such manner that one end thereof is connected to the oil collecting portion (47) and the other end thereof opens at an end surface of the bearing (41) that is located at a side of the covered end.

According to the fourth aspect of the present invention, because the lubricating oil flowing to the open end of the bearing (41) is conducted to the covered end of the bearing (41), the lubricating oil's flowing out of the open end of the bearing (41) can be suppressed.

Further, the fifth aspect of the present invention provides the compressor of the above-described third aspect of the invention, wherein the oil collecting portions (47*a*, 47*b*) are formed at both end portions of the bearing portion (45), and the oil passage (49) is formed at the bearing (41) in such manner that one end thereof opens at an end surface of the bearing (41) that is located at a side of the covered end and the other ends thereof are connected to the two oil collecting portions (47*a*, 47*b*).

According to the fifth aspect of the present invention, because the lubricating oil flowing to the both ends of the bearing (41) is collectively conducted to the certain portion, the lubricating oil's flowing out of the both ends of the bearing (41) can be suppressed.

Further, the sixth aspect of the present invention provides the compressor of the above-described third aspect of the invention, wherein an oil supply passage (29) is formed in the drive shaft (11) to supply the lubricating oil to a gap (43) between the drive shaft (11) and the bearing (41), and the oil passage (49) is formed at the drive shaft (11) in such manner that one end thereof is connected to the oil collecting portion (47) and the other end thereof is connected to the oil supply passage (29).

According to the sixth aspect of the present invention, the lubricating oil supplied to the gap (43) between the outer peripheral surface of the drive shaft (11) and the inner peripheral surface of the bearing (41) flows toward the both ends of the bearing (41), and then returns from the oil collecting portion (47) to the oil supply passage (29) through the oil passage (49). As a result, it can be suppressed that the lubricating oil supplied to the gap (43) between the drive shaft (11) and the bearing (41) flows out of the end portions of the bearing (41), and the structure can be also simplified.

Further, the seventh aspect of the present invention provides the compressor of the above-described sixth aspect of the invention, wherein the oil collecting portion (47) is formed at an end portion of the bearing portion (45) that is located at a side of the open end, and the oil passage (49) is formed so as to connect the oil collecting portion (47) to the oil supply passage (29).

According to the seventh aspect of the present invention, because the lubricating oil flowing to the open end of the bearing (41) is returned to the oil supply passage (29), the lubricating oil's flowing out of the one end of the bearing (41) can be suppressed and the structure can be also simplified.

Further, the eighth aspect of the present invention provides the compressor of the above-described sixth aspect of the invention, wherein the oil collecting portions (47*a*, 47*b*) are formed at both end portions of the bearing portion (45), and the oil passage (49) is formed so as to connect the respective oil collecting portions (47*a*, 47*b*) to the oil supply passage (29).

According to the eights aspect of the present invention, because the lubricating oil flowing to the both ends of the bearing (41) is returned to the oil supply passage (29), the lubricating oil's flowing out of the both ends of the bearing (41) can be suppressed and the structure can be also simplified.

Effects of the Invention

As described above, according to the present invention, because the oil collecting portion (47) is formed at the outer peripheral surface of the drive shaft (11) and the bearing (41) and the oil passage (49) is formed so as to conduct the lubricating oil flowing into the oil collecting portion (47) to the certain portion, the lubricating oil's flowing out of the ends of the bearing (41) can be suppressed. Also, because the lubricating oil supplied to the bearing portion (45) is conducted to the certain portion, the lubricating oil's flowing out to the outside can be suppressed, result in preventing leakage of the lubricating oil.

Further, because the lubricating oil is flowed without reducing the amount of thereof, smooth rotation of the drive shaft (11) can be maintained and deterioration of the cooling effect of the lubricating oil can also be prevented.

Further, according to the second aspect of the present invention, because it is prevented securely for the lubricating oil to flow out thorough the discharge pipe (27) opening close to the bearing (41), the leakage of the lubricating oil can be prevented securely.

Further, according to the third aspect of the present invention, because it is suppressed for the lubricating oil to flow out the open end of the bearing (41), the lubricating oil's flowing out through the discharge pipe (27) can be prevented securely.

Further, according to the fourth aspect of the present invention, because it is suppressed for the lubricating oil to flow to the open end of the bearing portion (45) and rather the lubricating oil is conducted to the side of the covered end thereof, the lubricating oil can be collected only at one side and thereby dealing with the lubricating oil can be done easily.

Further, according to the fifth aspect of the present invention, because the lubricating oil flowing to the both ends of the bearing portion (45) is collectively conducted to the certain portion, dealing with the lubricating oil can be done easily.

Further, according to the sixth aspect of the present invention, because the lubricating oil supplied to the bearing portion (45) is returned to the oil supply passage (29), dealing with the lubricating oil leaking from the bearing portion (45) can be decreased and the structure can be simplified.

Further, according to the seventh aspect of the present invention, because the lubricating oil flowing to the open end of the bearing portion (45) is suppressed securely and returned to the oil supply passage (29), dealing with only the lubricating oil flowing out from the one side should be done, and thereby dealing with the lubricating oil can be done easily.

Further, according to the eighth aspect of the present invention, because the lubricating oil flowing to the both ends of the bearing portion (45) is returned to the oil supply passage (29), there is no need to deal with the lubricating oil leaking from the bearing portion (45) and the structure can be simplified.

BEST MODE FOR CARRYING OUT THE INVENTION

EMBODIMENT 1

The first embodiment of the present invention will be described in detail with reference to drawings.

Figure 1:
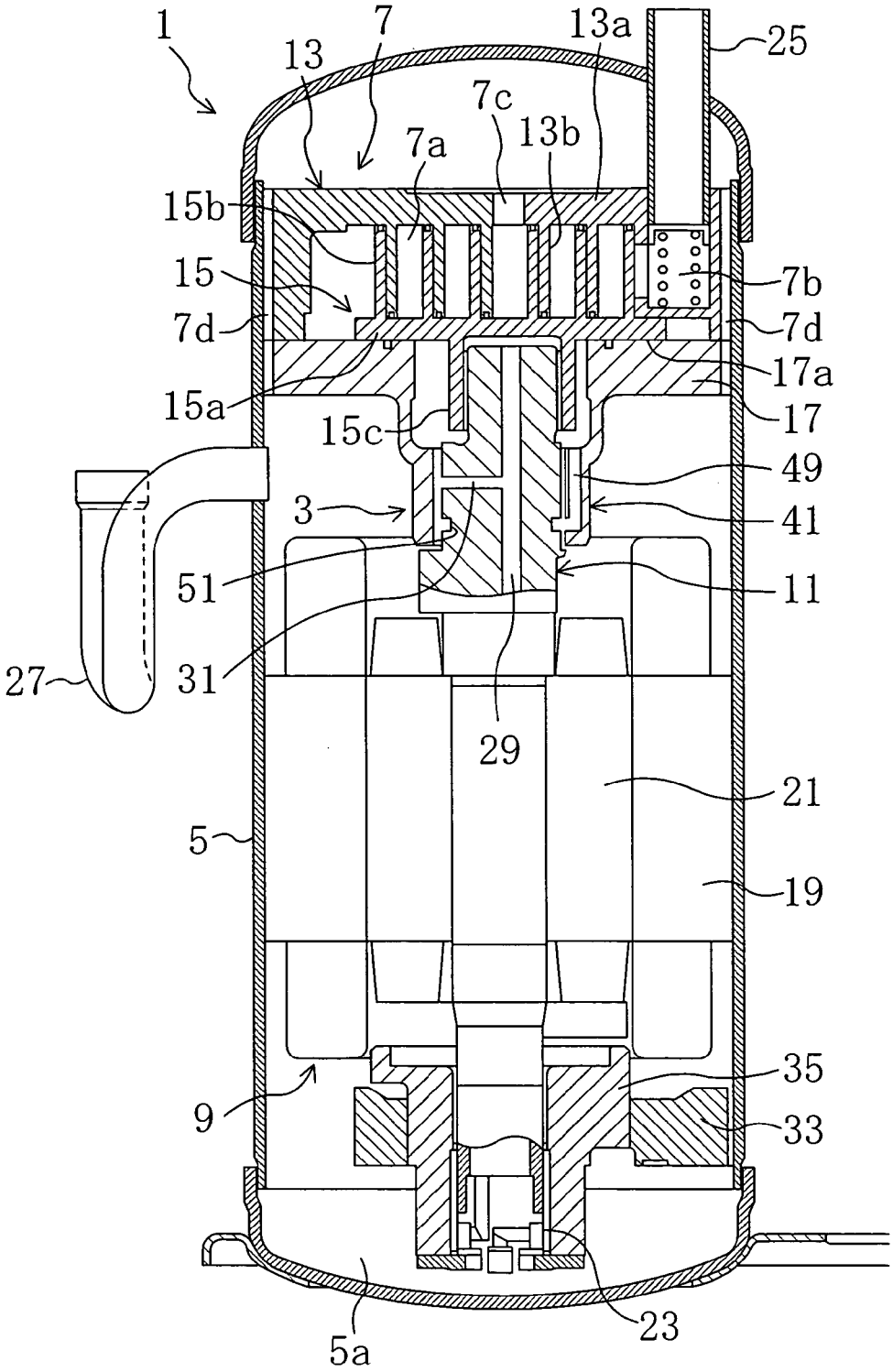
FIG. 1 is a sectional view of a compressor including a journal bearing according to the first embodiment of the present invention.

In the present embodiment, as shown in FIG. 1, a scroll-type compressor (1) comprises a journal bearing (3), and the compressor (1) is provided in a steam compressing-type refrigeration circuit, such as an air conditioner, to compress a coolant.

The compressor (1) comprises a casing (5), a scroll mechanism (7) disposed in the casing (5), and a motor (9) disposed in the casing (5). The scroll mechanism (7) and the motor (9) are coupled by a drive shaft (11) constituted of a shaft.

The scroll mechanism (7) comprises a fixed scroll (13) and a turning scroll (15) so that a compressing mechanism is constituted thereby. The fixed scroll (13) and the turning scroll (15) are formed respectively such that spiral laps (13*b*, 15*b*) are fixed on flat plat-shape base plates (13*a*, 15*a*). Also, the fixed scroll (13) and the turning scroll (15) are disposed in parallel with one another in such manner that their laps (13*b*, 15*b*) engage with each other to form a compressing chamber (7*a*).

The base plate (13*a*) of the fixed scroll (13) is attached to the casing (5) at outer peripheral portion thereof, while a frame (17) is attached to the casing (5). On the upper surface of the frame (17), the turning scroll (15) is disposed so as to revolve without rotating on its axis.

The motor (9) comprises a stator (19) and a rotor (21) to constitute drive means thereby, and the drive shaft (11) is inserted in the rotor (21) and coupled thereto. An upper end of the drive shaft (11) is inserted in a boss (15*c*) of the turning scroll (15) and coupled thereto. Also, an oil pump (23) is provided at a lower end portion of the drive shaft (11), and the oil pump (23) is placed in an oil reservoir (5*a*) which is at the bottom of the casing (5).

A suction pipe (25) is coupled to the upper portion of the casing (5), while a discharge pipe (27) is coupled to the central portion of a body of the casing (5). The suction pipe (25) is connected to a suction space (7*b*) that is located outside of the laps (13*b*, 15*b*), and the coolant is conducted in the compressing chamber (7*a*).

A discharge hole (7*c*) connected to the compressing chamber (7*a*) is formed at the central portion of the base plate (13*a*) of the fixed scroll (13). A coolant passage (7*d*) is formed between the casing (5) at the outer peripheral portion of the base plate (13*a*) in the fixed scroll (13) and the peripheral portion of the flame (17). The coolant passage (7*d*) is formed so as to extend in the perpendicular direction and conduct the coolant from the upper part of the fixed scroll (13) to the lower part of the frame (17).

An oil supply passage (29) is formed in the drive shaft (11). The oil supply passage (29) extends from the lower end of the drive shaft (11) to the upper end of the drive shaft (11), and the lower end of the oil supply passage (29) is connected to the oil pump (23). The upper portion of the drive shaft (11) is supported at the casing (5) by the journal bearing (3), while the lower end of the drive shaft (11) is supported at the casing (5) by a lower bearing (35) through a supporting member (33).

The journal bearing (3) is constituted such that it supports the drive shaft (11), in which a bearing (41) is formed at the frame (17), through which the drives shaft (11) passes, and the lubricating oil is supplied from the oil supply passage (29) through a branch passage (31). The bearing (41) is formed at central recessed portion of the frame (17), and its lower end is constituted of an open end that is exposed from the frame (17), while its upper end is constituted of a covered end that is covered by the frame (17). Herein, the discharge pipe (27) is coupled to a portion of the casing (5), which is located about at the side of the journal bearing (3).

Figure 2:
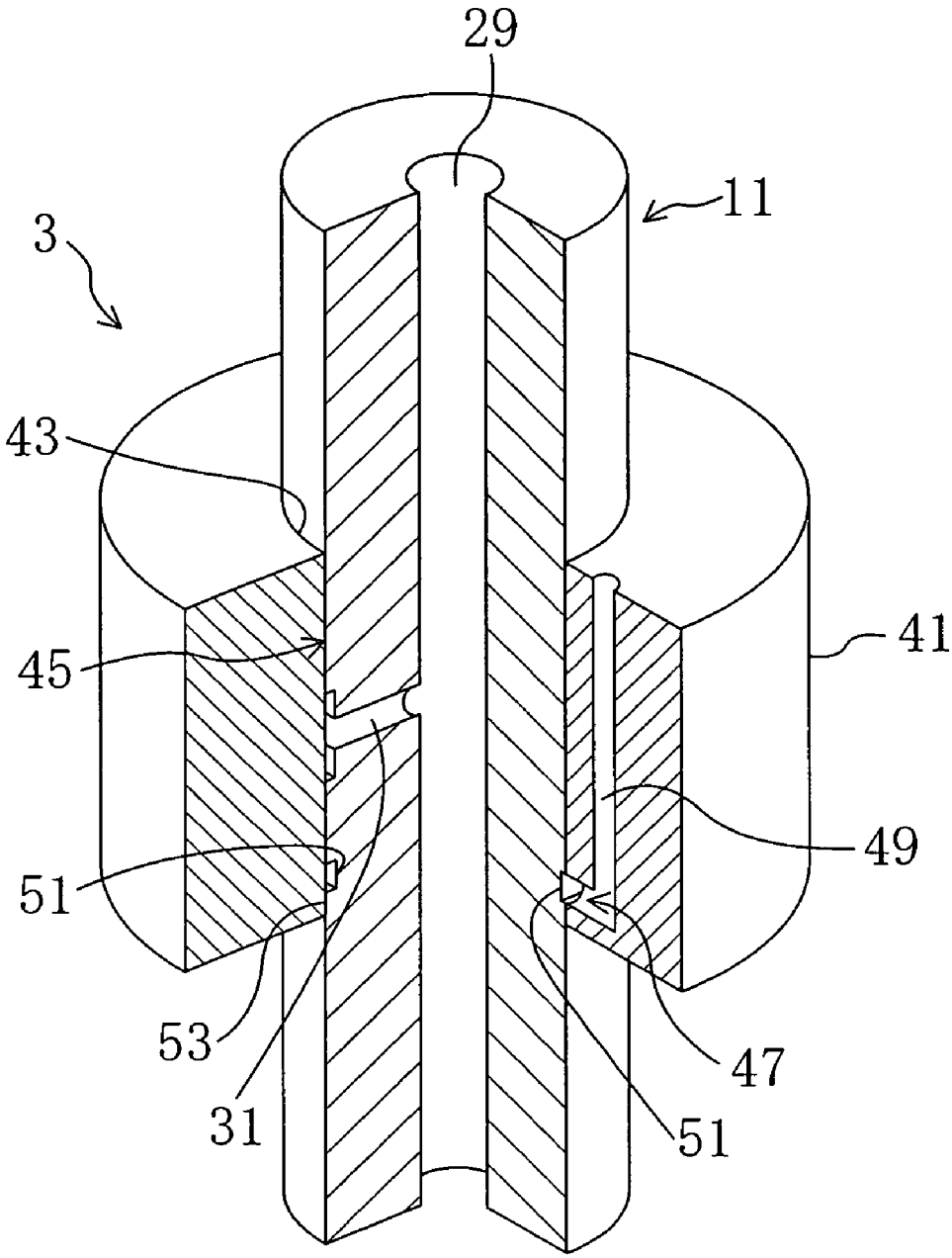
FIG. 2 is a perspective view showing the inside of the journal bearing, taking out a part of the journal bearing according to the first embodiment.
Figure 3:
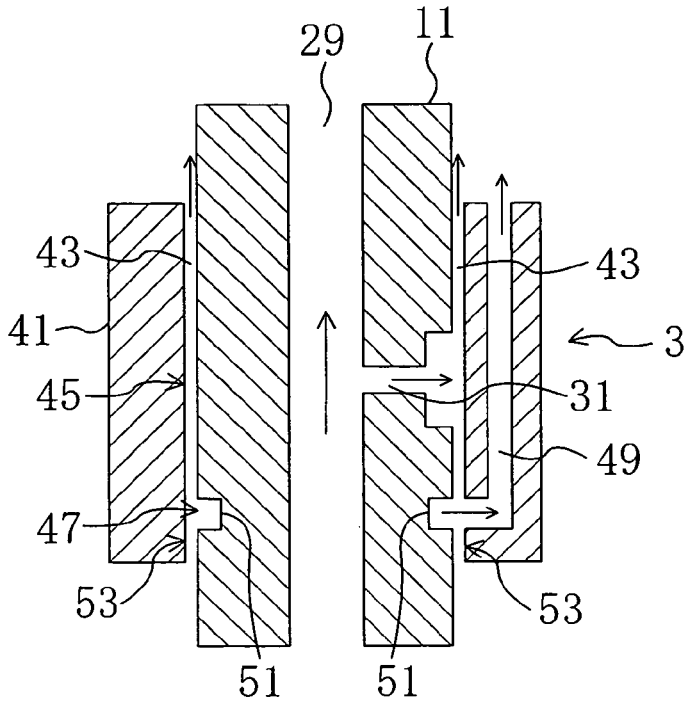
FIG. 3 is a sectional view of the journal bearing according to the first embodiment.

The journal bearing (3), as shown in FIGS. 2 and 3, supports the drive shaft (11) so that the drive shaft (11) rotates therein, supplying the lubricating oil to the gap (43) between the outer peripheral surface of the drive shaft (11) and the inner peripheral surface of the bearing (41), and constitutes a bearing portion (45) by the outer peripheral surface of the drive shaft (11) and the inner peripheral surface of the bearing (41). The branch passage (31) of the oil supply passage (29) opens at the outer peripheral surface of the drive shaft (11), which is located at the central portion of the bearing (41) in the perpendicular direction.

An oil collecting portion (47) and oil passage or oil discharge passage (49) are formed at the journal bearing (3). The oil collecting portion (47) is provided to collect the lubricating oil that has been supplied to the gap (43) between the drive shaft (11) and the bearing (41), and it is disposed at the lower end portion of the bearing portion (45) and includes an oil groove (51).

The oil groove (51) is formed at an end portion of the bearing portion (45) that is located at the side of the open end. Specifically, the oil groove (51) is formed at the outer peripheral surface of the drive shaft (11) in the periphery direction, which is located at the lower end portion of the bearing (41) corresponding to the open end portion of the bearing (41). The oil groove (51) is constituted of a ring-shape groove having a depth of 100 μm or more, which is formed at the entire periphery of the drive shaft (11). Also, a lower portion of the inner peripheral surface of the bearing (41) from a portion which corresponds to the oil groove (51) constitutes a sealing portion (53).

The oil passage (49) is constituted such that one end thereof opens at the lower end portion of the inner peripheral surface of the bearing (41) which corresponds to the oil groove (51), while the other end thereof opens at the upper end surface of the bearing (41). Thereby, the lubricating oil flowing into the oil collecting portion (47) can be conducted to the certain portion, namely the upper end surface of the bearing (41). Herein, the lubricating oil flowing up to the upper end surface of the bearing (41) flows to a thrust bearing (17*a*) on the upper end surface of the frame (17).

Functions

A compressing action of the above-described compressor (1) will be described hereinafter.

First, according to operation of the motor (9), the turning scroll (15) revolves to the fixed scroll (13) through the drive shaft (11), without rotating on its own axis, and thereby the compressing chamber (7*a*) formed between the laps (13*b*, 15*b*) moves spirally from the outside to the central portion, reducing the displacement thereof. Meanwhile, the coolant in the coolant circuit flows in the suction space (7*b*) through the suction pipe (25), and then flows into the compressing chamber (7*a*) of the scroll mechanism (7). The coolant in the compressing chamber (7*a*) is compressed by the compressing chamber (7*a*) reducing its displacement, and flows in the inside of the casing (5) thorough the discharge hole (7*c*). Then, this coolant with a high pressure flows from the upper part of the casing (5), through the coolant passage (7*d*), down to the lower part of the casing (5), and flows into the coolant circuit through the discharge pipe (27).

The lubricating oil in the oil reservoir (5*a*) at the lower portion of the casing (5), by the operation of the oil pump (23), flows though the oil supply passage (29) and is supplied to the journal bearing (3) and the like. At the journal bearing (3), the lubricating oil flows into the gap (43) between the outer peripheral surface of the drive shaft (11) and the inner peripheral surface of the bearing (41) and is supplied to the bearing portion (45).

Figure 4:
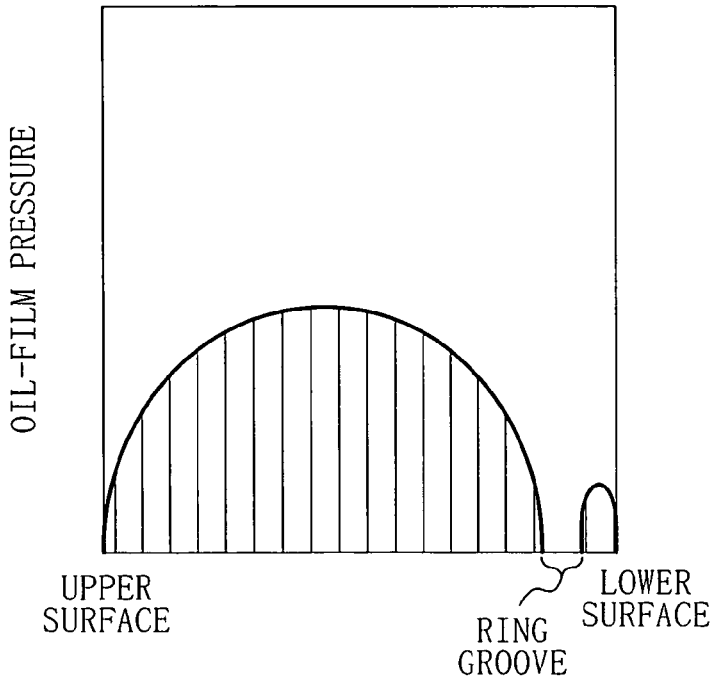
FIG. 4 is a diagram showing a distribution of oil-film pressure at the journal bearing according to the first embodiment.

The lubricating oil supplied to the bearing portion (45) generates an oil-film pressure as shown in the characteristics diagram of FIG. 4 by wedge effect. In this characteristics diagram, the lateral axis shows a position in the lateral direction of the bearing portion (45), while the longitudinal axis shows an oil-film pressure. Because the oil-film pressure at the both of lower and upper end surfaces of the bearing (45) are equivalent to the atmospheric pressure of the inside of the casing (5), the distribution of the oil-film pressure has the greatest oil-film pressure at its central portion in the axis direction of the bearing portion (45), having a mountain-like shape with the peak of the pressure at the central portion of the baring portion (45). Namely, the lubricating oil supplied from the branch passage (31) of the oil supply passage (29) flows towards the both of upper and lower ends of the bearing (41), and the drive shaft (11) is supported by the bearing (41) so as to rotate therein.

Also, the lubricating oil flowing toward the open end at the lower end of the bearing (41) flows to the oil collecting portion (47) and flows in the oil groove (51). The oil collecting portion (47) has almost the same pressure as the atmosphere pressure in the inside of the casing (5) due to the connection to the oil passage (49), and the lubricating oil in the oil collecting portion (47) flows through the oil passage (49) to the upper end surface of the bearing (41). Then, the lubricating oil flows to the thrust bearing (17*a*) of the frame (17). Namely, the oil collecting portion (47) constitutes sealing portion of the lubricating oil. As a result, the amount of the lubricating oil flowing out of the lower surface of the journal bearing (3) decreases, and thus the lubricating oil flowing out through the discharge pipe (27) along with the coolant decreases.

Effects of Embodiment 1

According to the first embodiment, because the lubricating oil flows from the oil collecting portion (47) which is at the one end of the bearing portion (45) to the other end portion of the bearing (41) through the oil passage (49), a part of the lubricating oil supplied to the gap (43), which reaches the lower surface of the bearing (41), decreases, so that the leakage of the lubricating oil from the lower surface of the bearing (41) can be suppressed. As a result, the lubricating oil flowing out through the discharge pipe (27), which is located close to the journal bearing (3), along with the coolant can be reduced.

Further, because the oil passage (49) is placed at a portion facing to the oil groove (51), the lubricating oil in the oil collecting portion (47) can be discharged out easily. As a result, it can be prevented that the lubricating oil stagnates in the oil groove (51) and the gap (43). Accordingly, conventional problems, such as prevention of smooth rotation of the drive shaft (11) and deterioration of cooling effect of the lubricating oil, can be avoided.

Further, because the oil groove (51) is formed at the lower part of the bearing (41), there exists a large distance between the branch passage (31) of the oil supply passage (29) and the oil groove (51). As a result, the lubricating oil supplied to the gap (43) can spread over the gap (43) properly, thereby providing a secure bearing function.

EMBODIMENT 2

Next, the second embodiment of the present invention will be described in detail with reference to drawings.

Figure 5:
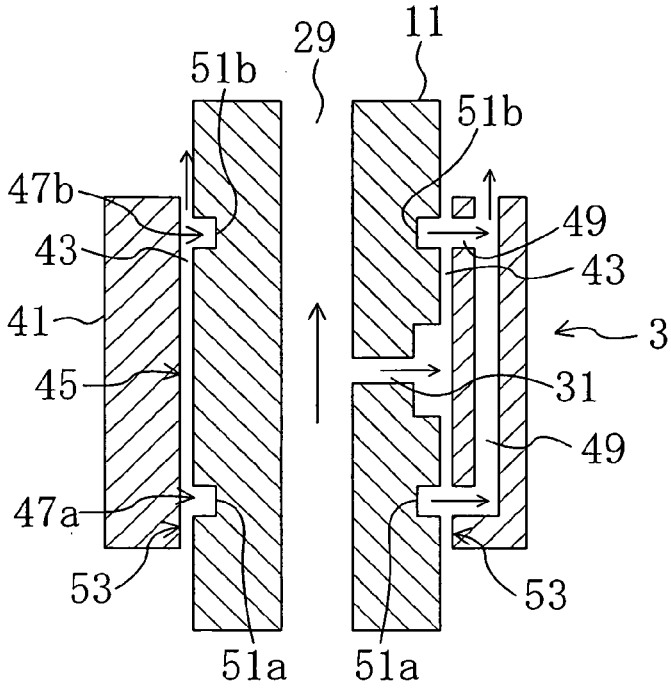
FIG. 5 is a sectional view of a journal bearing according to the second embodiment of the present invention.

As shown in FIG. 5, the present embodiment is constituted such that it has two oil collecting portions (47*a*, 47*b*), instead of one oil collecting portion (47) that the first embodiment has.

Namely, the bearing portion (45) is provided with the first oil collecting portion (47*a*) and the second oil collecting portion (47*b*). The first oil collecting portion (47*a*) is formed at the lower part (open end side) of the bearing portion (45), including the first oil groove (51*a*). The second oil collecting portion (47*b*) is formed at the upper part (covered end side) of the bearing portion (45), including the second oil groove (51*b*). Meanwhile, the oil passage (49) is constituted such that it is connected to the first and the second oil collecting portions (47*a*, 47*b*). Other structure is the same as the first embodiment.

Accordingly, as shown in FIG. 1, when the lubricating oil is supplied to the journal bearing (3) by the oil pump (23), it flows into the gap (43) between the outer peripheral surface of the drive shaft (11) and the inner peripheral surface of the bearing (41), and thereby the bearing (41) supports the drive shaft (11) through the oil film. Meanwhile, the lubricating oil supplied to the bearing portion (45) flows toward both of upper and lower ends and flows to the first and second oil collecting portions (47*a*, 47*b*), then into the first and second oil grooves (51*a*, 51*b*), respectively.

Each of the lubricating oil of the first and second oil grooves (51*a*, 51*b*) flows through the oil passage (49) and then flows out on the upper surface of the bearing (41). Other functions and effects of the present embodiment are the same as the first embodiment.

EMBODIMENT 3

Next, the third embodiment of the present invention will be described in detail with reference to drawings.

Figure 6:
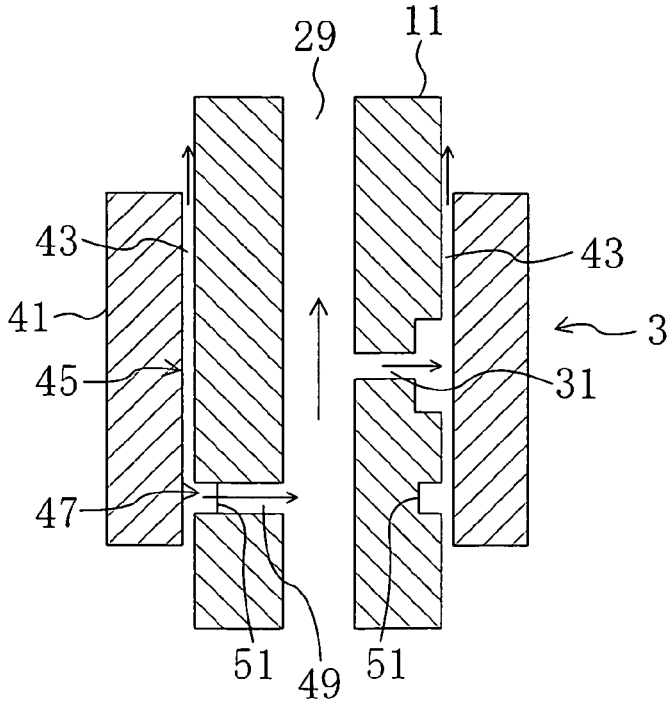
FIG. 6 is a sectional view of a journal bearing according to the third embodiment of the present invention.

As shown in FIG. 6, the present embodiment is constituted such that the oil passage (49) is formed at the drive shaft (11), instead of the oil passage (49) of the first embodiment that is formed at the bearing (41).

The oil passage (49) is formed such that it connects between the oil groove (51) and the oil supply passage (29). Namely, the oil passage (49) is formed so as to return the lubricating oil, which has flowed in the oil collecting portion (47), to the oil supply passage (29).

Next, the flow of the lubricating oil at the journal bearing (3) of the above-described compressor (1) will be described.

As shown in FIG. 1, when the lubricating oil is supplied to the journal bearing (3) by the oil pump (23), the lubricating oil flows into the gap (43) between the outer peripheral surface of the drive shaft (11) and the inner peripheral surface of the bearing (41) and the bearing (41) supports the drive shaft (11) through the oil film. Meanwhile, the lubricating oil supplied to the bearing portion (45) flows toward both of the upper and lower ends, and the lubricating oil flowing toward the lower end flows to the oil collecting portion (47), then into the oil groove (51). The lubricating oil of the oil grove (51) returns to the oil supply passage (29) through the oil passage (49).

Namely, the lubricating oil is supplied to the bearing portion (45) from the branch passage (31) of the oil supply passage (29) by a centrifugal force. The lubricating oil flows toward the load side by the rotation, and the pressure occurs by wedge effect. Then, the lubricating oil flows into the oil groove (51). The pressure of the lubricating oil of the oil groove (51) is greater than the centrifugal force, and thus the lubricating oil of the oil groove (51) returns to the oil supply passage (29) through the oil passage (49). Then, the lubricating oil of the oil supply passage (29) is supplied again to bearing portion (45).

Accordingly, according to the present embodiment, because the lubricating oil that has been supplied to the bearing portion (45) returns again to the oil supply passage (29), the structure can be simplified. Other structure, functions and effects of the present embodiment are the same as the first embodiment.

EMBODIMENT 4

Next, the fourth embodiment of the present invention will be described in detail with reference to drawings.

Figure 7:
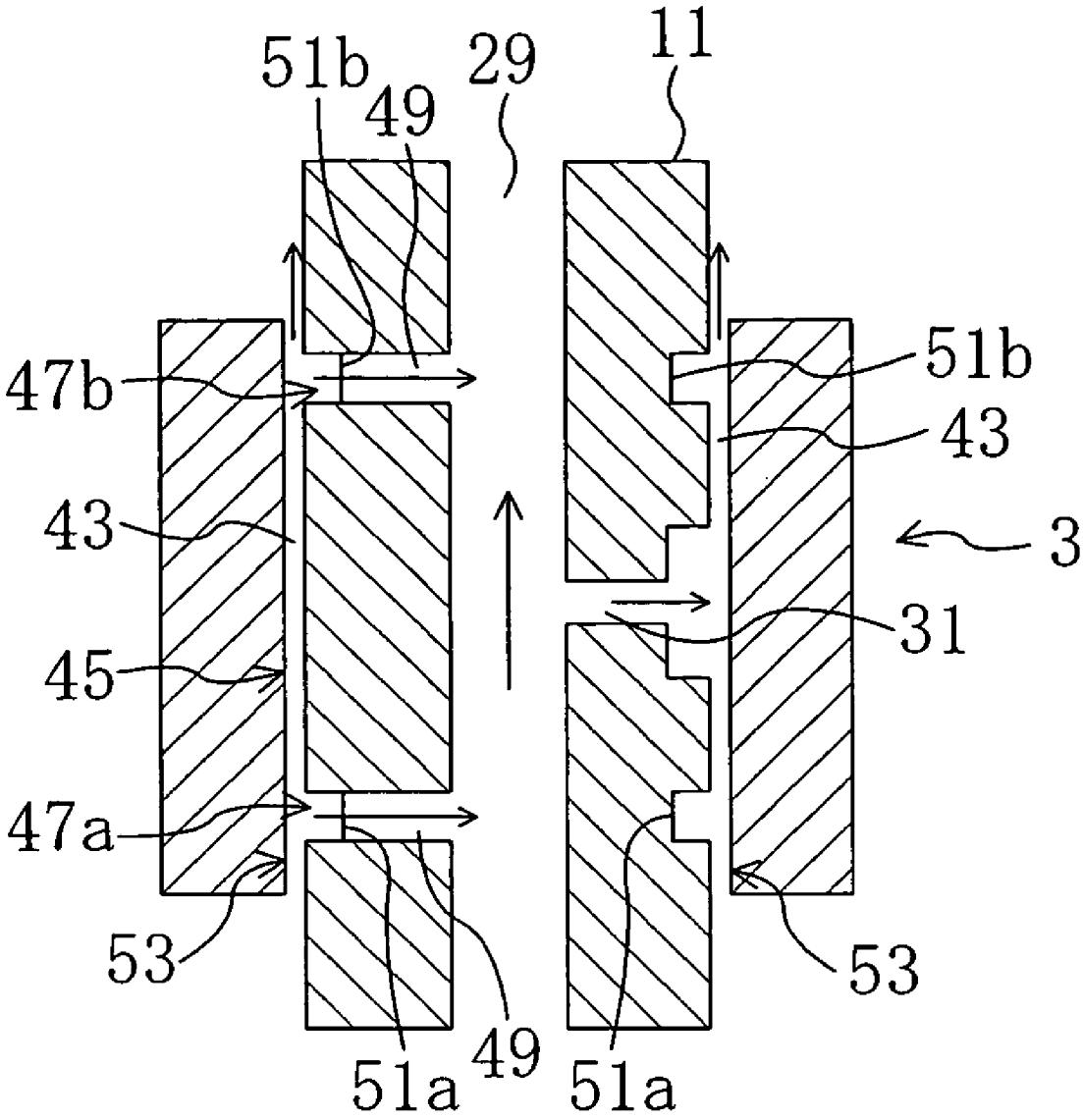
FIG. 7 is a sectional view of a journal bearing according to the fourth embodiment of the present invention.
Figure 8:
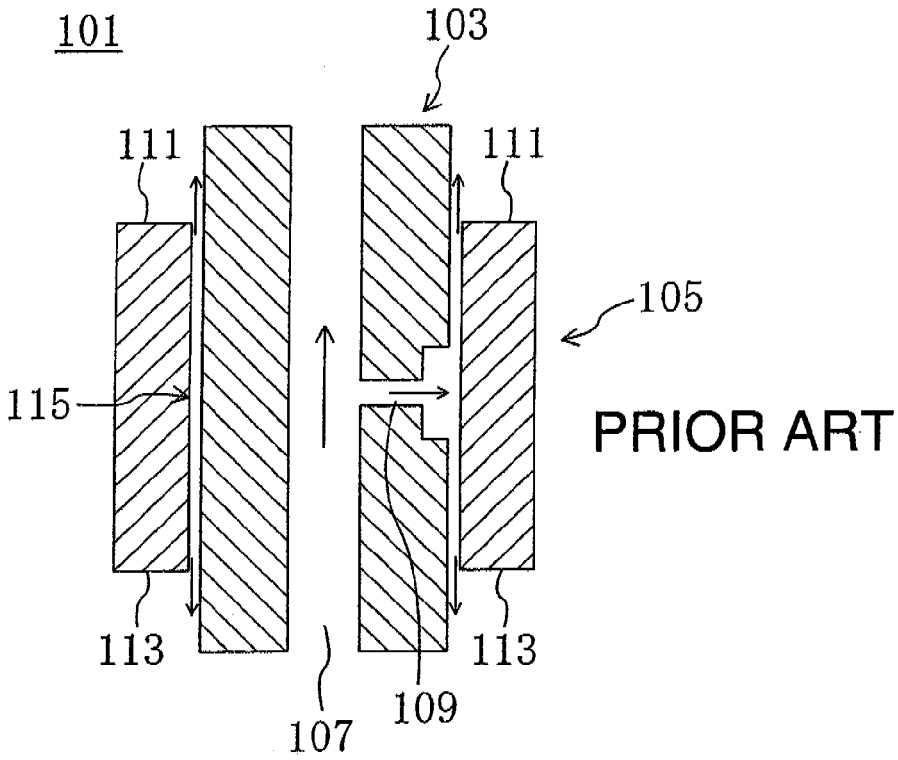
FIG. 8 is a sectional view of a conventional journal bearing.
Figure 9:
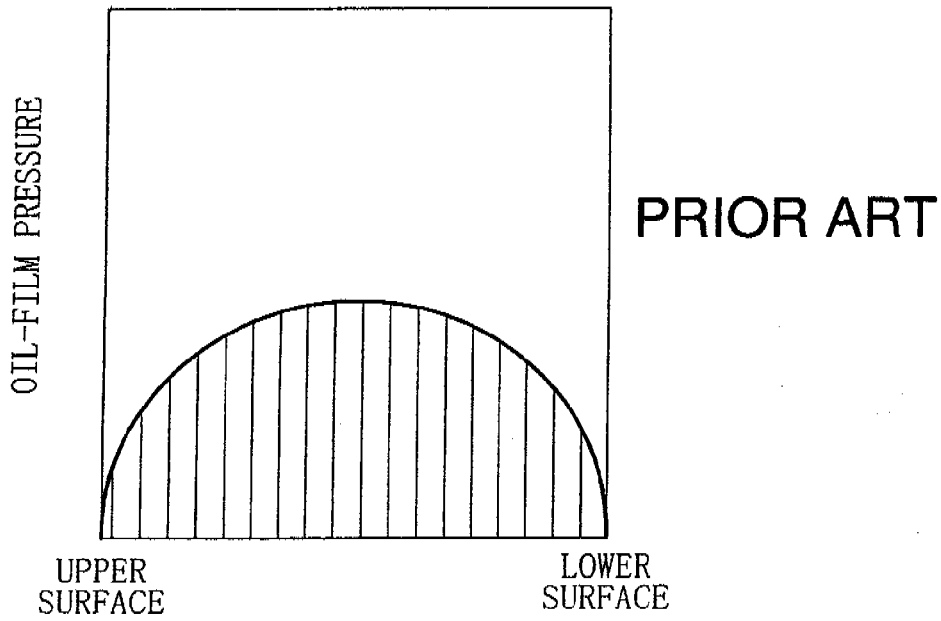
FIG. 9 is a diagram showing a distribution of oil-film pressure at the conventional journal bearing.

As shown in FIG. 7, the present embodiment is constituted such that it has two oil collecting portions (47*a*, 47*b*) and two oil passages (49, 49), instead of one oil collecting portion (47) and one oil supply passage (49) that the third embodiment has.

Namely, the bearing portion (45) is provided with the first oil collecting portion (47*a*) and the second oil collecting portion (47*b*). The first oil collecting portion (47*a*) is formed at the lower part (open end side) of the bearing portion (45), including the first oil groove (51*a*). The second oil collecting portion (47*b*) is formed at the upper part (covered end side) of the bearing portion (45), including the second oil groove (51*b*). Meanwhile, one oil passage (49) is constituted so as to connect the first oil collecting portion (47*a*) to the oil supply passage (29), while the other oil passage (49) is constituted so as to connect the second oil collecting portion (47*b*) to the oil supply passage (29). Other structure of the present embodiment is the same as the third embodiment.

Accordingly, as shown in FIG. 1, when the lubricating oil is supplied to the journal bearing (3) by the oil pump (23), the lubricating oil flows into the gap (43) between the outer peripheral surface of the drive shaft (11) and the inner peripheral surface of the bearing (41) and the bearing (41) supports the drive shaft (11) through the oil film. Meanwhile, the lubricating oil supplied to the bearing portion (45) flows toward both of the upper and lower ends, and the lubricating oil flows to the first and second oil collecting portions (47*a*, 47*b*), then into the first and second oil grooves (51*a*, 51*b*), respectively. Each of the lubricating oil of the first and second oil grooves (51*a*, 51*b*) flows through the oil passage (49) and then returns to the oil supply passage (29). Other functions and effects of the present embodiment are the same as the third embodiment.

OTHER EMBODIMENTS

Although the two oil supply passages (49, 49) in the above-described fourth embodiment are connected respectively to the oil supply passage (29), it may be constituted such that one of the oil passage (49) is formed at the bearing (41) and the lubricating oil flows out on the end surface of the bearing (41), like the first embodiment.

Further, the oil groove (51) in each embodiment described above may be formed on the inner peripheral surface of the bearing (41), instead of the outer peripheral surface of the drive shaft (11).

Further, although the oil supply passage (29) is formed at the drive shaft (11) in the first and second embodiments, it may be constituted such that the oil supply passage (29) is formed at the bearing (41) and the lubricating oil is supplied to the gap (43) between the drive shaft (11) and the bearing (41) from the side of the bearing (41).

Further, although the oil groove (51) is formed on the outer peripheral surface of the drive shaft (11) which is located at the lower part of the bearing portion (45) in the first and third embodiments, it is not limited by this structure, but the oil groove (51) may be formed at a portion which is located at the upper part of the bearing portion (45). In this case, it can be suppressed that the lubricating oil supplied to the gap (43) flows out of the upper surface of the bearing (41).

Further, it is not necessary that the oil groove (51) is formed in a ring shape. It may be formed such that a part of its circumferential portion is cut out.

Further, although one end of the oil passage (49) opens at the upper end surface, namely the covered end of the bearing (41) in the first and second embodiments, the certain portion where the lubricating oil is conducted is not limited by this structure, but any portion may be adopted as long as the lubricating oil can be treated therein.

Further, although the journal bearing (3) according to the above-described embodiments is applied to the scroll-type compressor (1), it is not limited by this structure, but it may be applied to the other type of the compressor, such as rotary-type compressor.

Further, although the axis direction of the journal bearing (3) is parallel to the perpendicular direction in the above-described embodiments, it is not limited by this structure, but it may be at right angles with the perpendicular direction.

INDUSTRIAL APPLICABILITY

As described above, the compressor according to the present invention is useful when including the journal bearing, especially as measures against a leakage of lubrication oil.

The invention claimed is:

1. A compressor, comprising:

a casing having a driving mechanism and a compressing mechanism coupled to said driving mechanism by a drive shaft disposed therein, said drive shaft being rotatably supported by a bearing;

a lubricating oil supplied between said drive shaft and said bearing, said drive shaft forming a branch passage that supplies said lubricating oil from said drive shaft to a bearing portion;

an oil collecting portion disposed at a first end portion in an axis direction of said bearing portion, provided to collect said lubricating oil supplied to said bearing portion and including an oil groove formed in a periphery direction of the drive shaft, said bearing portion being constituted of an outer peripheral surface of said drive shaft and an inner peripheral surface of said bearing; and an oil discharge passage provided to conduct said lubricating oil collected in said oil collecting portion toward a second end portion of said bearing portion.

2. The compressor of claim 1, wherein a discharge pipe opening at a portion close to said bearing is attached to said casing.

3. The compressor of claim 1, wherein said bearing is formed at a frame that is attached to said casing, and one end of said bearing is constituted of an open end that is exposed from said frame, while the other end of said bearing is constituted of a covered end that is covered by said frame.

4. The compressor of claim 3, wherein said oil collecting portion is formed at an end portion of said bearing portion that is located at a side of said open end, and one end of said oil discharge passage is connected to said oil collecting portion and another end of said oil discharge passage opens at an end surface of said bearing that is located at a side of said covered end.

5. A compressor comprising:

a casing having a driving mechanism and a compressing mechanism coupled to said driving mechanism by a drive shaft disposed therein, said drive shaft being rotatably supported by a bearing, said bearing being formed at a frame that is attached to said casing, one end of said bearing being constituted of an open end that is exposed from said frame, and another end of said hearing being constituted of a covered end that is covered by said frame;

a lubricating oil supplied between said drive shaft and said bearing;

an oil collecting portion disposed at an end portion in an axis direction of a bearing portion, provided to collect said lubricating oil supplied to said bearing portion and including an oil groove formed in a periphery direction of the drive shaft, said bearing portion being constituted of an outer peripheral surface of said drive shaft and an inner peripheral surface of said bearing; and an oil passage provided to discharge said lubricating oil collected in said oil collecting portion, said oil collecting portions being formed at both end portions of said bearing portion, and said oil passage being formed at said bearing in such manner that one end thereof opens at an end surface of said bearing that is located at a side of said covered end and the other ends thereof are connected to said two oil collecting portions.

6. A compressor comprising:

a casing having a driving mechanism and a compressing mechanism coupled to said driving mechanism by a drive shaft disposed therein, said drive shaft being rotatably supported by a bearing, said bearing being formed at a frame that is attached to said casing, one end of said bearing being constituted of an open end that is exposed from said frame, and another end of said bearing being constituted of a covered end that is covered by said frame;

a lubricating oil supplied between said drive shaft and said bearing;

an oil collecting portion disposed at an end portion in an axis direction of a bearing portion, provided to collect said lubricating oil supplied to said bearing portion and including an oil groove formed in a periphery direction of the drive shaft, said bearing portion being constituted of an outer peripheral surface of said drive shaft and an inner peripheral surface of said bearing;

an oil passage provided to discharge said lubricating oil collected in said oil collecting portion; and an oil supply passage formed in said drive shaft to supply the lubricating oil to a gap between the drive shaft and said bearing, and said oil passage being formed at said drive shaft in such manner that one end thereof is connected to said oil collecting portion and the other end thereof is connected to said oil supply passage.

7. The compressor of claim 6, wherein said oil collecting portion is formed at an end portion of said bearing portion that is located at a side of said open end.

8. The compressor of claim 6, wherein said oil collecting portions are formed at both end portions of said bearing portion, and said oil passage is formed so as to connect said respective oil collecting portions to said oil supply passage.

9. A compressor comprising:

a casing having a driving mechanism and a compressing mechanism coupled to said driving mechanism by a drive shaft disposed therein, said drive shaft being rotatably supported by a bearing, said bearing being formed at a frame that is attached to said casing, one end of said bearing being constituted of an open end that is exposed from said frame, and another end of said bearing being constituted of a covered end that is covered by said frame;

a lubricating oil supplied between said drive shaft and said bearing, said drive shaft forming a branch passage that supplies said lubricating oil from said drive shaft to a bearing portion;

a plurality of oil collecting portions, each disposed at an end portion in an axis direction of said bearing portion and including an oil groove formed in a periphery direction thereof, said bearing portion being constituted of an outer peripheral surface of said drive shaft and an inner peripheral surface of said bearing; and an oil discharge passage provided to conduct said lubricating oil collected in said oil collecting portions to said covered end and disposed at said bearing, one end of said oil discharge passage being located at a side of said covered end and another end of said oil discharge passage being connected to said oil collecting portions.

10. A compressor comprising:

a casing having a driving mechanism and a compressing mechanism coupled to said driving mechanism by a drive shaft disposed therein, said drive shaft being rotatably supported by a bearing, said bearing being formed at a frame that is attached to said casing, one end of said bearing being constituted of an open end that is exposed from said frame, and another end of said bearing being constituted of a covered end that is covered by said frame;

a lubricating oil supplied between said drive shaft and said bearing;

an oil collecting portion disposed at an end portion in an axis direction of a bearing portion and including an oil groove formed in a periphery direction thereof, said bearing portion being constituted of an outer peripheral surface of said drive shaft and an inner peripheral surface of said bearing;

an oil supply passage formed in said drive shaft to supply said lubricating oil to a gap between said drive shaft and said bearing; and an oil passage provided to discharge said lubricating oil collected in said oil supply passage, said oil passage being formed at said drive shaft such that one end of the oil passage is connected to said oil collecting portion and another end of the oil passage is connected to said oil supply passage.

11. The compressor of claim 10, wherein said oil collecting portion is formed at an end portion of said bearing portion that is located at a side of said open end.

12. The compressor of claim 10, wherein said oil collecting portion is formed at each of said ends of said bearing portion and said oil passage is formed so as to connect a respective one of said oil collecting portions to said oil supply passage.

* * * * *